US008297443B2

(12) United States Patent
Ogando

(10) Patent No.: US 8,297,443 B2
(45) Date of Patent: Oct. 30, 2012

(54) CONVERTIBLE BOX

(75) Inventor: Juan C. Ogando, Maplewood, NJ (US)

(73) Assignee: Juicy Couture, Inc., New York, NY (US)

( * ) Notice: Subject to any disclaimer, the term of this patent is extended or adjusted under 35 U.S.C. 154(b) by 100 days.

(21) Appl. No.: 12/772,196

(22) Filed: May 1, 2010

(65) Prior Publication Data

US 2011/0266195 A1 Nov. 3, 2011

(51) Int. Cl.
*B65D 1/22* (2006.01)

(52) U.S. Cl. ..... 206/750; 206/45.23

(58) Field of Classification Search ..... 206/6.1, 206/751, 752, 45.2, 45.21, 45.22, 45.23, 206/750; 220/831, 832, 819, 817, 818, 826; 229/124, 125, 125.08, 125.11, 125.33, 125.35, 229/125.36

See application file for complete search history.

(56) References Cited

U.S. PATENT DOCUMENTS

| | | | | | |
|---|---|---|---|---|---|
| 216,737 | A * | 6/1879 | Heylmann | 206/45.23 |
| 939,234 | A * | 11/1909 | Eichorn | 206/45.23 |
| 1,209,343 | A * | 12/1916 | Shampanier | 206/45.23 |
| 1,701,065 | A * | 2/1929 | Darragh | 206/45.22 |
| 2,775,342 | A * | 12/1956 | Smith | 206/379 |
| 2,790,542 | A * | 4/1957 | Hillman | 206/45.2 |
| 5,007,530 | A * | 4/1991 | Weismantel | 206/45.21 |
| 5,607,054 | A * | 3/1997 | Hollingsworth | 206/320 |
| 5,690,213 | A * | 11/1997 | Matsumura | 206/45.21 |
| 6,745,900 | B2 * | 6/2004 | Lambert | 206/581 |
| 6,758,330 | B1 * | 7/2004 | Chudada | 206/6.1 |
| 7,694,932 | B1 * | 4/2010 | Ngan | 206/45.28 |
| 7,735,644 | B2 * | 6/2010 | Sirichai et al. | 206/320 |

* cited by examiner

*Primary Examiner* — Andrew Perreault
(74) *Attorney, Agent, or Firm* — Leydig, Voit & Mayer, Ltd.

(57) ABSTRACT

A convertible box includes a body having a back panel and side panels that define a cavity and an opening. A lid is hingeably connected to the body and disposed to cover the opening when the convertible box is in a closed condition. The lid is arranged to hingeably move relative to the body such that the lid is disposed in abutting relationship with the back panel when the convertible box is in an open condition.

14 Claims, 3 Drawing Sheets

CONVERTIBLE BOX

BACKGROUND

The disclosure generally relates to small containers or boxes, such as those used for displaying or packaging jewelry and other items. Typically, jewelry, watches, and other such items are displayed on a store rack, which may be placed on a counter. Exemplary racks used for display may include one or more flat display faces that may be mounted on a rotatable base to enable a customer to quickly look through the items on display.

Each display face of a typical display rack may include a plurality of regularly spaced hooks or openings, each of which is configured to support a particular item for display. Items are usually placed within boxes that are either open or transparent to allow the customers to view the contents. Open boxes in particular are used to display jewelry and other items that have visual appeal. To support the boxes on the rack, disposable attachments to the boxes, such as removable plastic hooks, have been used in the past. For example, a removable plastic hook that attaches into an opening of the box may be used to hang the box from an opening in the display rack. When an item in its box is selected by a customer, a sales associate may remove the box from the display, remove and dispose of the hook, and retrieve a lid or other closure of the box such that the item may be purchased in its packaging, which may be gift wrapped.

This type of known product display and packaging arrangement presents certain disadvantages. For one, the cost of merchandise packaging is increased by the use of the disposable plastic clips. Further, waste is created by the disposable clips used to mount the open boxes to the display. Even further, the lids for the open display boxes are stored near the display for use when items are selected for purchase, thus taking up space and time for the sales associate to retrieve them.

BRIEF SUMMARY OF THE INVENTION

A convertible box that can be used for both packaging as well as display of items, for example, jewelry and the like, is provided. Unlike known boxes and displays, the embodiments of the convertible box disclosed herein require no removable clips for mounting the box to a display rack, nor do they require a separate lid. In this way, an item may be placed on a display while still in its packaging. When selected for purchase, the item may be simply removed from the display and the package be closed with no additional steps or parts.

As set forth in more detail in the paragraphs that follow, in one aspect, the disclosure describes a convertible box. The box includes a body having a back panel and side panels that define a cavity and an opening. A lid is hingeably connected to the body and disposed to cover the opening when the convertible box is in a closed condition. The lid is arranged to hingeably move relative to the body such that the lid is disposed in abutting relationship with the back panel when the convertible box is in an open condition.

In another aspect, the disclosure describes a display and packaging box for jewelry or accessories. The box includes a body having a back panel and side panels peripherally connected to the back panel around an edge thereof, and a cavity defined between the side panels and the back panel. The cavity has an opening surrounded by an open edge and is adapted to enclose an insert that is configured to engage a piece of jewelry. A lid hingeably connected to the body is disposed to cover the opening when the convertible box is in a packaging condition. The lid is further arranged to hingeably move relative to the body such that the lid is disposed in abutting relationship with the back panel when the convertible box is in an display condition.

In yet another aspect, the disclosure describes a method for packaging and displaying merchandise on a display rack. The method includes mounting a piece of merchandise onto an insert, and placing the insert into a cavity of a convertible box. The lid of the box, which is hingeably connected to a body of the box, is placed in engaging contact with a back panel of the box. A hook that is connected to the lid of the box is engaged on a display rack. When removing the box from the display rack, the lid is rotated relative to the body to cover the insert and enclose the same within the cavity while the hook is still connected to the lid.

DETAILED DESCRIPTION OF THE INVENTION

The exemplary embodiment presented herein relates to a convertible box for the display and packaging of small jewelry items, such as pendants, earrings, and the like, but it should be appreciated that the design features and functions described in the paragraphs that follow are equally applicable to other sizes and types of boxes. For example, the convertible box of the present disclosure may be embodied in a smaller size, such as for a ring, a larger size, such as for a necklace or bracelet, or a specialized item, such as for a watch, wallet, key ring, and so forth.

Figure 1:
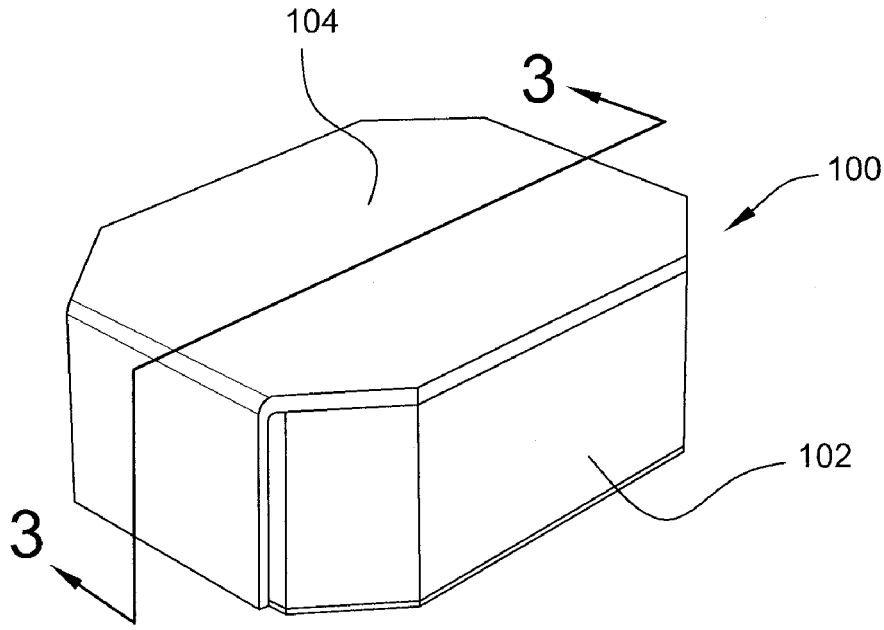
FIGS. 1 and 2 are outline views of a convertible box in accordance with the disclosure.
Figure 2:
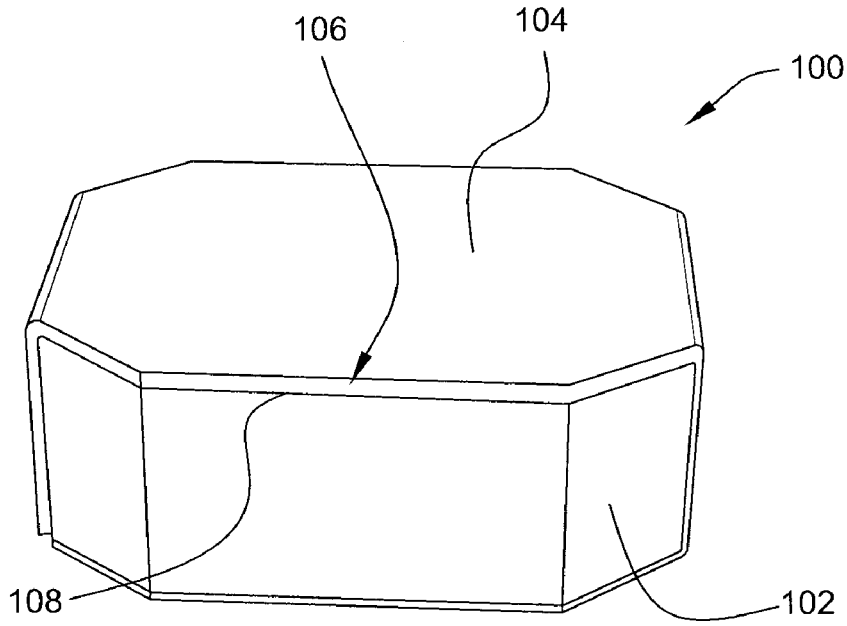

With the foregoing in mind, a convertible box 100 is shown in a closed or packaging position from an outline perspective in FIG. 1 and from a side view in FIG. 2. In the description that follows, features or elements that are the same or similar to features and elements shown and described relative to other figures are denoted by the same reference numerals as previously used for simplicity. In reference now to FIGS. 1 and 2, the convertible box 100 includes a body 102 and a lid 104. As shown, the convertible box 100 stylistically has a generally oblong octagonal shape, which is carried through the body 102 and lid 104, but any other shape may be used to achieve a desired styling, such as rectangular, elliptical, circular, and so forth. In the illustrated embodiment, the lid 104 has a rim portion 106 that overlaps an outer edge 108 of the body 102, as is best shown in FIGS. 3 and 4.

Figure 3:
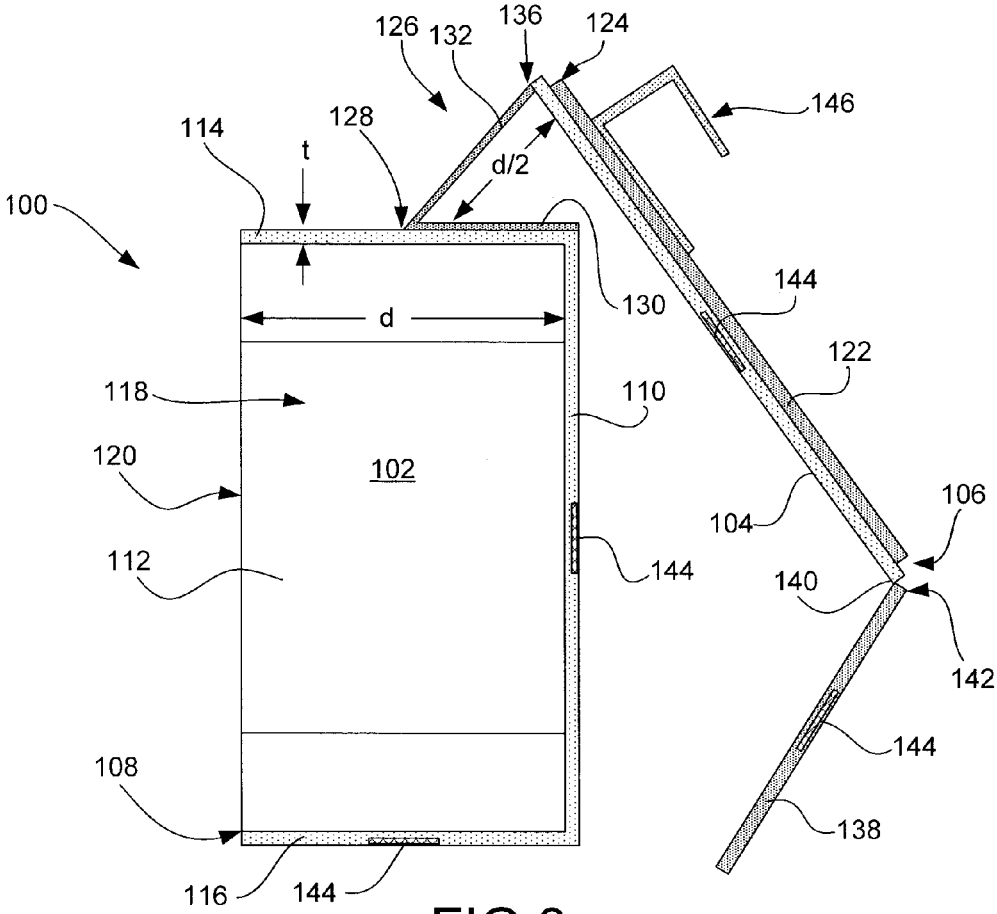
FIGS. 3 and 4 are, respectively, a cross section and a side view of a convertible box in a transitional position between open and closed positions in accordance with the disclosure.
Figure 4:
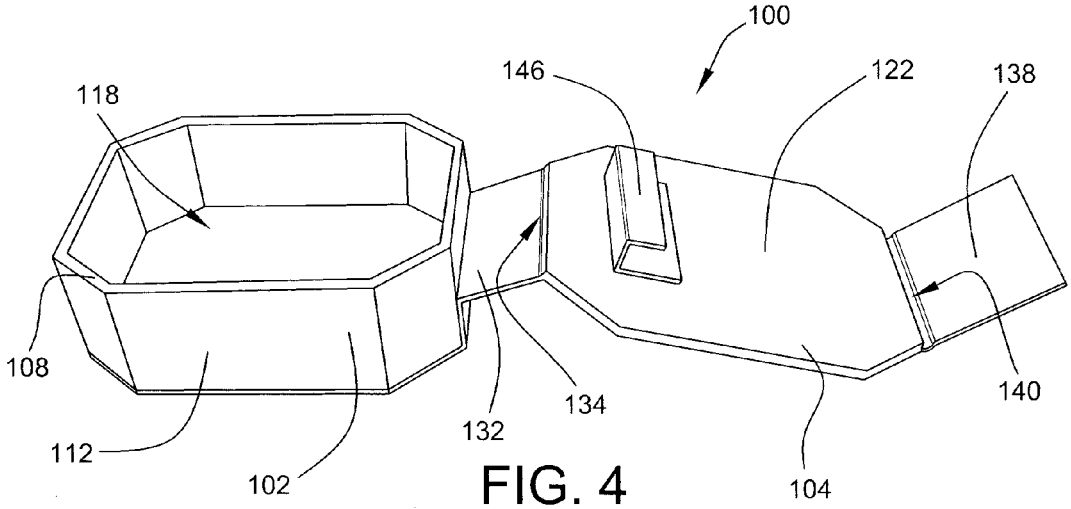

FIG. 3 is a cross section along line 3-3, as shown in FIG. 1, and FIG. 4 is an outline view from the side of the convertible box 100. In FIGS. 3 and 4, the convertible box 100 is shown in a partially open position for illustration. As shown in the figures, the body 102 and lid 104 are made of a generally rigid material, such as laminated cardboard, which has a thickness, t. The body 102 is made of various panels of this material, which can be formed as flat panels and constructed into the shape of the body 102 or, alternatively, made from a single-piece panel that is folded or otherwise formed into the appropriate shape. In the illustrated embodiment, the body 102 is formed by a back panel 110, variously sized side panels 112, a top panel 114, and a bottom panel 116. The side, top, and bottom panels 112, 114, and 116 are connected peripherally around the edges of the back panel 110 to form side walls and a back wall around a cavity 118, which is accessible or open along one side thereof that forms an opening 120.

The lid 104 in the illustrated embodiment includes an inner panel 122, which is flat and disposed along substantially an inner face of the lid 104 when the box 100 is in the closed position. The inner panel 122 is preferably smaller than the lid 104 such that a ledge 124 is defined along the rim portion 106. In the illustrated embodiment, the inner panel 122 fits within the opening 120 while rim portion 106 abuts the outer edge 108 of the body 102 when the box 100 is in the closed position. Such arrangement advantageously provides a positive closure that resists the egress of portions of the contents of the box 100 when used as a packaging, such as portions of thin cross section chain (not shown) or other small items that may be placed within the box 100.

Figure 6:
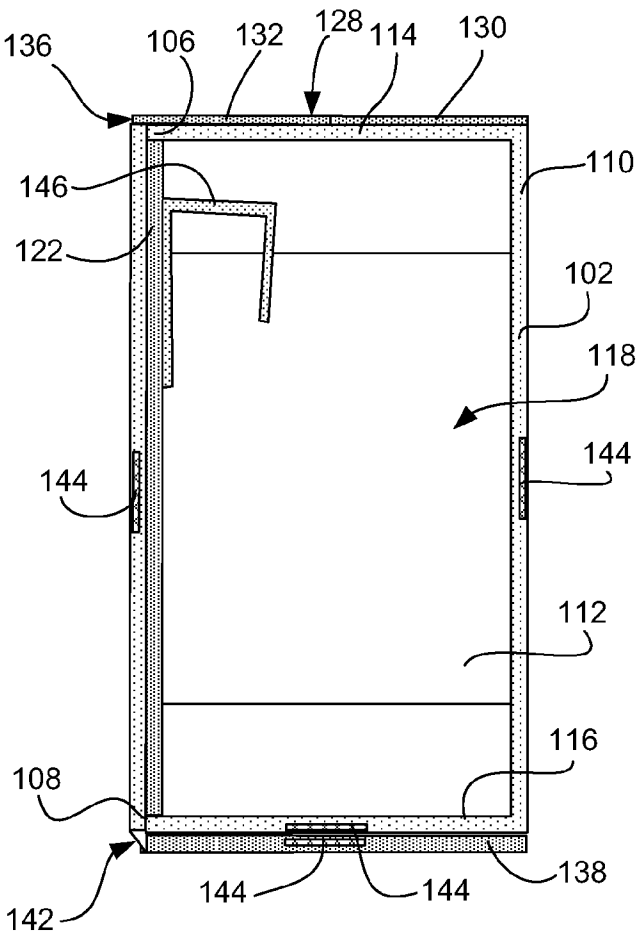
FIG. 6 is a cross section of a convertible box in a closed or packaged position.
Figure 5:
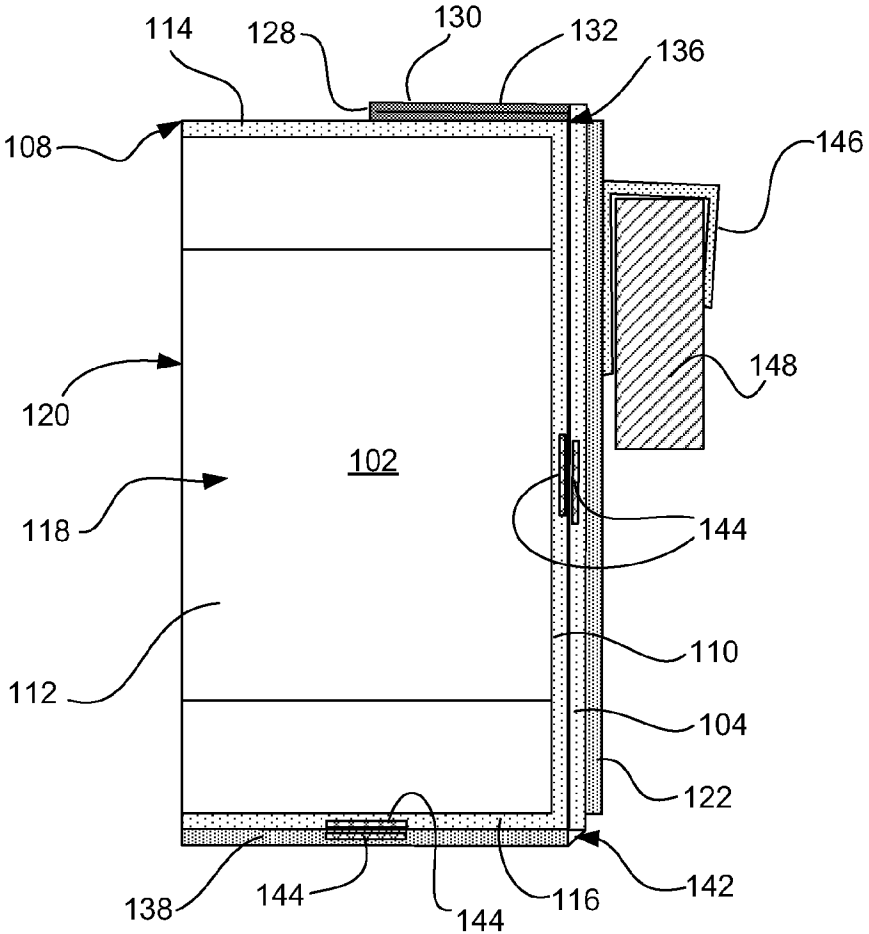
FIG. 5 is a cross section of a convertible box in an open or display position.

The lid 104 is hingeably connected and configured to eccentrically rotate over an angle of about 360 degrees relative to body 102. In this way, the lid 104 may assume positions relative to the body 102 that are either aligned with the opening 120, such as when the box 100 is in the closed or packaged position (as shown in FIGS. 1, 2, and 6), or in a position where the lid 104 is substantially disposed in parallel contact with the back panel 110 (FIG. 5).

To accomplish this type of motion between the body 102 and lid 104, the box 100 includes a compound hinge or linkage 126. The linkage 126 preferably includes two flat panels that are hingeably connected to one another along a first hinge axis 128. The first or body panel 130 is connected to the top panel 114 of the body 102 and extends along the entire width of the top panel 114 between the interface with the back panel 110. The body panel 130 extends over a distance, d/2, that is about one half of a height, d, of the body 102. The second or lid panel 132 is connected to the body panel 130 and arranged to rotate relative thereto about the first hinge axis 128. The lid panel 132 is also hingeably connected to a top edge 134 of the lid 104 such that it rotates relative thereto about a second hinge axis 136. In the illustrated embodiment, an optional clasp panel 138 is hingeably connected to a bottom edge 140 of the lid 104 and arranged to rotate about a third hinge axis 142.

The convertible box 100 is advantageously arranged to maintain the open or closed positions by use of engaging members, such as adhesive strips, contact pads, hook and loop pads (e.g., Velcro®), or, as in the illustrated embodiment, magnets 144. As shown, the magnets 144 are embedded within various panels of the convertible box 100, and are positioned at appropriate locations that permit the magnets 144 to interact with one another depending on the position of the lid 104 relative to the body 102. Although various methods may be used to embed the magnets 144 into the various panels of the box 100 depending on the particular construction and aesthetic appeal desired for each box design, the magnets 144 of the illustrated embodiment are mounted within appropriately sized openings in the cardboard or other base construction material used to construct the box 100. In this arrangement, the magnets 144 are covered by the thin layer of lamination that is disposed thereon. The lamination material, which may be, for example, colored and plasticized paper having a thickness of about 0.010 thousandths of an inch (about 0.25 millimeters), is thick enough to disguise the magnets 144 but also thin enough so as not to substantially interfere with attractive magnetic forces between mating pairs of magnets 144, as is described in further detail in the paragraphs that follow.

As shown, for example, in FIG. 3, a pair of magnets 144 is embedded in various panels of the box 100. More specifically, one pair of magnets 144 is embedded between the back panel 110 and the lid 104. Another pair of magnets 144 is embedded between the bottom panel 116 of the body 102 and the clasp panel 138. It should be appreciated that the presence of the optional clasp panel 138 that has a magnet 144 may also require the inclusion of the magnet 144 in the bottom panel 116, but both such magnets and, further, the clasp panel 138, may be omitted.

The lid 104 advantageously includes a hook 146 or other structural feature that is useful when mounting the box 100 onto a stand for display of its contents. For example, and in reference to FIGS. 5 and 6, the hook 146 may releasably engage a portion of a display rack 148 (shown partially in cross section) when the box 100 is mounted to the stand for display in the known fashion. In contrast to known designs having removable hooks that engage a box, the hook 146 of the illustrated embodiment is connected to a portion of the inner panel 122 of the lid 104 such that the hook 146 is exposed when the lid 104 is in the open or display position as shown in FIG. 5. When a customer or sales associate selects and dismounts a particular box 100 from the section of the rack 148, the lid 104 may be flipped to the closed or packaged position, as shown in FIG. 6, without having to remove and discard the hook as was the case in previous designs. In the illustrated embodiment, when the lid 104 in the packaged or closed position relative to the body 102 (FIG. 6), the hook 146 is entirely disposed within the cavity 118. In this position, the hook 146 is not only hidden from view and will not interfere with the aesthetics of the exterior of the box 100 which, for example, may be gift wrapped, but can also serve as a retainer that can hold the contents of the box 100 (not shown) from shaking during transport or, alternatively, be arranged to remain clear of the contents.

The box 100 is advantageously configured to "lock" into either of the display or packaged positions. In reference to FIGS. 5 and 6, it can be seen that when in the display position (FIG. 5), the lid 104 is rotated entirely around the body 102 such that it abuts the back panel 110. When in this position, the magnets 144 disposed in the back panel 110 and the lid 104 create an attractive magnetic force therebetween that is sufficient to maintain contact between the lid 104 and the back panel 110 of the body 102 while the box 100 is on display. Optionally, the magnets 144 disposed in the clasp panel 138 and bottom panel 116 provide an additional magnetic attractive force tending to further engage the lid 104 in contact with the back panel 110.

When transitioning from the display position (FIG. 5) to the packaged position (FIG. 6), the attractive magnetic force between the one, and optionally two, pair(s) of magnets 144 is destroyed by pulling the lid 104 away from the back panel 110. As the lid 104 swings towards the front of the body 102 (an intermediate position is shown in FIG. 3, as previously discussed), the first and second rotational axes 128 and 136 provide the rotational freedom of motion via the lid panel 132 for the lid 104 to eccentrically rotate about one full rotation. The eccentric full rotation of the lid 104 brings the lid 104 into position in front of the opening 120 such that the cavity 118 is enclosed when the box 100 is closed. In this position, the lid panel 132, which was previously positioned on top of the body panel 130, is now in contact with the top panel 114.

There are a number of different structural configurations that can provide positive engagement between the lid 104 and the body 102 when the box 100 is in the closed or package position. In the illustrated embodiment, the clasp panel 138 may once again engage the bottom panel 116 such that the pair of magnets 144 can once again create their attractive magnetic force that will retain the clasp panel 138, and thus the lid 104, in contact with the body 102. Alternative embodiments may include other placement for the magnets 144, for example, along the rim portion 106 of the lid 104 and within the thickness "t" of the outer edge 108, and so forth. Even further, alternative engagement devices may be used, as previously discussed, such as releasable adhesives and contact pads.

In the embodiment illustrated, laminated cardboard was used for making the various panels of the box 100, but any other appropriate material may be used. It is noted that given the tough yet flexible properties of the material used, the first, second, and third rotation axes 128, 136, and 142 may be simply formed by providing creases in the material in appropriate locations, such as localized bending of the material along linear portions without additional structures or features, for example, piano-style hinges, and so forth. However, when other types of material are used to form the box 100, such as plastic or metal sheet materials, more particular hinge structures may be used.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A convertible box, comprising:

a body having a back panel and side panels peripherally connected to the back panel around an edge thereof, the side panels including a bottom panel;

a cavity defined between the side panels and the back panel and having an opening surrounded by an open edge;

a lid hingeably connected to the body, the lid being disposed to cover the opening when the convertible box is in a closed condition, and the lid being further arranged to hingeably move relative to the body such that the lid is disposed in abutting relationship with the back panel when the convertible box is in an open condition;

a clasp panel hingeably connected to the lid along a bottom edge thereof and disposed to rotate relative thereto about a third hinge axis; and a hook connected to the lid on an inner side thereof, such that the hook extends away from the lid and the back panel when the convertible box is in the open condition;

wherein each of the lid and the back panel includes an engagement device for providing a force tending to maintain the lid in contact with the back panel when the convertible box is in the open condition; and wherein each of the clasp panel and the bottom panel includes a clasp engaging device for providing a clasp force tending to maintain the clasp panel in contact with the bottom panel when the convertible box is either in the closed or in the open conditions.

2. The convertible box of claim 1, wherein the hook is adapted to engage an opening in a display rack for mounting the convertible box to the display rack such that an article disposed in the cavity is displayed on the display rack.

3. The convertible box of claim 1, wherein the hook extends within the cavity when the convertible box is in the closed condition.

4. The convertible box of claim 1, wherein the side panels include a top panel, and wherein the convertible box further comprises a hinge panel connected to the top panel and disposed to rotate relative thereto about a first hinge axis, the hinge panel further connected to a top edge of the lid and disposed to rotate relative thereto about a second hinge axis.

5. The convertible box of claim 4, wherein the top panel extends between the back panel and the open edge having a first length, wherein the hinge panel has a second length that is about half of the first length, and wherein the first hinge axis is disposed at about a midsection of the top panel such that the hinge panel can rotate between the open edge and a top edge of the back panel.

6. The convertible box of claim 1, wherein the force is a magnetic force provided by magnets embedded in the corresponding panels.

7. The convertible box of claim 1, wherein the clasp force is a magnetic force provided by magnets embedded in the corresponding panels.

8. A display and packaging box for jewelry or accessories, comprising:

a body having a back panel and side panels peripherally connected to the back panel around an edge thereof;

a cavity defined between the side panels and the back panel and having an opening surrounded by an open edge, the cavity adapted to enclose an insert that is configured to engage a piece of jewelry;

a lid hingeably connected to the body, the lid being disposed to cover the opening when the convertible box is in a packaging condition, and the lid being further arranged to hingeably move relative to the body such that the lid is disposed in abutting relationship with the back panel when the convertible box is in a display condition;

a hook permanently connected to the lid on an inner side thereof, such that the hook extends away from the lid and the back panel when the convertible box is in the display condition;

a clasp panel hingeably connected to the lid along a bottom edge thereof and disposed to rotate relative thereto about a third hinge axis;

wherein each of the lid and the back panel includes an engagement device for providing a force tending to maintain the lid in contact with the back panel when the convertible box is in the display condition; and wherein each of the clasp panel and the bottom panel includes a clasp engaging device for providing a clasp force tending to maintain the clasp panel in contact with the bottom panel when the convertible box is either in the packaging or in the display conditions.

9. The box of claim 8, wherein the hook is adapted to engage an opening in a display rack for mounting the box to the display rack such that the piece of jewelry is displayed on the display rack.

10. The box of claim 8, wherein the hook extends within the cavity when the convertible box is in the packaging condition and is adapted to prevent the piece of jewelry from moving during transport.

11. The box of claim 8, wherein the side panels include a top panel, and wherein the convertible box further comprises a hinge panel connected to the top panel and disposed to rotate relative thereto about a first hinge axis, the hinge panel further connected to a top edge of the lid and disposed to rotate relative thereto about a second hinge axis, such that the lid is configured to perform one substantially full eccentric rotation relative to the body.

12. The box of claim 11, wherein the top panel extends between the back panel and the open edge having a first length, wherein the hinge panel has a second length that is about half of the first length, and wherein the first hinge axis is disposed at about a midsection of the top panel such that the hinge panel can rotate between the open edge and a top edge of the back panel.

13. The box of claim 8, wherein each of the side panels, back panel, and lid is made of laminated cardboard.

14. A method for packaging and displaying merchandise on a display rack, comprising:

providing a convertible box having a lid that is hingeably connected to a body of the box, the convertible box further comprising:

a body having a back panel and side panels peripherally connected to the back panel around an edge thereof;

a cavity defined between the side panels and the back panel and having an opening surrounded by an open edge, the cavity adapted to enclose an insert that is configured to engage a piece of jewelry;

wherein the lid is disposed to cover the opening when the convertible box is in a packaging condition, and the lid is further arranged to hingeably move relative to the body such that the lid is disposed in abutting relationship with the back panel when the convertible box is in a display condition;

a hook permanently connected to the lid on an inner side thereof, such that the hook extends away from the lid and the back panel when the convertible box is in the display condition;

a clasp panel hingeably connected to the lid along a bottom edge thereof and disposed to rotate relative thereto about a third hinge axis;

wherein each of the lid and the back panel includes an engagement device for providing a force tending to maintain the lid in contact with the back panel when the convertible box is in the display condition; and wherein each of the clasp panel and the bottom panel includes a clasp engaging device for providing a clasp force tending to maintain the clasp panel in contact with the bottom panel when the convertible box is either in the packaging or in the display conditions;

displaying the merchandise by placing the lid of the box in engaging contact with the back panel of the box by rotating the lid relative to the body, and engaging the hook that is connected to the lid of the box onto the display rack; and packaging the merchandise in the convertible box by rotating the lid relative to the body to enclose the merchandise within the cavity of the body while the hook is still connected to the lid.

* * * * *